US009556806B1

(12) United States Patent
O'Brien et al.

(10) Patent No.: US 9,556,806 B1
(45) Date of Patent: Jan. 31, 2017

(54) SYSTEMS AND METHODS FOR CONTROLLING A ROTATIONAL SPEED OF A MARINE INTERNAL COMBUSTION ENGINE

(71) Applicant: Brunswick Corporation, Lake Forest, IL (US)

(72) Inventors: William P. O'Brien, Eden, WI (US); Jason S. Arbuckle, Horicon, WI (US)

(73) Assignee: Brunswick Corporation, Lake Forest, IL (US)

( * ) Notice: Subject to any disclaimer, the term of this patent is extended or adjusted under 35 U.S.C. 154(b) by 3 days.

(21) Appl. No.: 14/574,953

(22) Filed: Dec. 18, 2014

Related U.S. Application Data

(60) Provisional application No. 61/994,221, filed on May 16, 2014.

(51) Int. Cl.

| | |
|---|---|
| ***B63H 20/00*** | (2006.01) |
| ***B63H 21/21*** | (2006.01) |
| ***F02D 11/10*** | (2006.01) |
| ***F02D 29/02*** | (2006.01) |
| ***B63H 1/12*** | (2006.01) |

(52) U.S. Cl.
CPC ..... *F02D 29/02* (2013.01); *B63H 1/12* (2013.01); *B63H 20/007* (2013.01); *B63H 21/21* (2013.01); *B63H 21/213* (2013.01); *B63H 2021/216* (2013.01); *F02D 11/105* (2013.01)

(58) Field of Classification Search
CPC ..... B63H 20/007; B63H 21/21; B63H 21/213; B63H 2021/216; F02D 11/105
See application file for complete search history.

(56) References Cited

U.S. PATENT DOCUMENTS

| | | | |
|---|---|---|---|
| 2,775,328 | A | 12/1956 | Yokel |
| 4,939,660 | A | 7/1990 | Newman et al. |
| 5,080,064 | A | 1/1992 | Buslepp et al. |

(Continued)

FOREIGN PATENT DOCUMENTS

| | | |
|---|---|---|
| WO | 00/68744 | 11/2000 |

OTHER PUBLICATIONS

Motion Control Coordinate System, www.newport.com, pp. 7-2 through 7-25, website visited Nov. 18, 2014.

(Continued)

*Primary Examiner* — Todd Melton
(74) *Attorney, Agent, or Firm* — Andrus Intellectual Property Law, LLP

(57) ABSTRACT

A system for controlling a rotational speed of a marine internal combustion engine has a first operator input device for controlling a speed of the engine in a trolling mode, in which the engine operates at a first operator-selected engine speed so as to propel a marine vessel at a first non-zero speed. A second operator input device controls the engine speed in a non-trolling mode, in which the engine operates at a second operator-selected engine speed so as to propel the marine vessel at a second non-zero speed. A controller is in signal communication with the first operator input device, the second operator input device, and the engine. In response to an operator request to transition from the trolling mode to the non-trolling mode, the controller determines whether to allow the transition based on the second operator-selected engine speed and a current engine speed.

15 Claims, 5 Drawing Sheets

(56) References Cited

U.S. PATENT DOCUMENTS

| | | | | |
|---|---|---|---|---|
| 5,836,851 | A | 11/1998 | Ruman | |
| 5,848,582 | A | 12/1998 | Ehlers et al. | |
| 5,884,213 | A | 3/1999 | Carlson | |
| 6,009,371 | A | 12/1999 | Kobayashi | |
| 6,152,102 | A | 11/2000 | Ruman | |
| 6,273,771 | B1 | 8/2001 | Buckley et al. | |
| 6,298,824 | B1 | 10/2001 | Suhre | |
| 6,425,370 | B1 | 7/2002 | Kramer | |
| 6,561,016 | B1 | 5/2003 | Suhre et al. | |
| 6,587,765 | B1 | 7/2003 | Graham et al. | |
| 6,701,890 | B1 | 3/2004 | Suhre et al. | |
| 6,757,606 | B1 | 6/2004 | Gonring | |
| 7,163,000 | B2 | 1/2007 | Ishida et al. | |
| 7,261,605 | B2 | 8/2007 | Misao et al. | |
| 7,357,120 | B2 * | 4/2008 | Kaji | B63H 21/213 123/350 |
| 7,422,501 | B2 * | 9/2008 | Mizushima | B63H 21/21 440/84 |
| 7,473,149 | B2 | 1/2009 | Mizokawa | |
| 7,556,547 | B2 | 7/2009 | Kaji | |
| 7,917,283 | B2 | 3/2011 | Kado | |
| 7,976,354 | B2 * | 7/2011 | Kubota | B63H 20/007 440/63 |
| 8,340,847 | B2 * | 12/2012 | Sako | B63H 21/21 701/21 |
| 8,762,022 | B1 | 6/2014 | Arbuckle et al. | |
| 9,145,839 | B1 | 9/2015 | Andrasko | |
| 9,156,536 | B1 | 10/2015 | Arbuckle et al. | |
| 9,381,989 | B1 | 7/2016 | Poirier | |
| 2002/0086593 | A1 | 7/2002 | Shidara et al. | |
| 2003/0000500 | A1 | 1/2003 | Chatfield | |
| 2003/0027468 | A1 | 2/2003 | Into | |
| 2003/0054704 | A1 | 3/2003 | Kanno | |
| 2003/0109184 | A1 | 6/2003 | Kanno | |
| 2003/0120360 | A1 | 6/2003 | Yasui et al. | |
| 2004/0069271 | A1 | 4/2004 | Kanno et al. | |
| 2004/0069272 | A1 | 4/2004 | Allen et al. | |
| 2006/0047406 | A1 | 3/2006 | Chatfield et al. | |
| 2006/0166573 | A1 | 7/2006 | Vetta et al. | |
| 2008/0051979 | A1 | 2/2008 | Yasui et al. | |
| 2008/0280511 | A1 | 11/2008 | Kado | |
| 2010/0191397 | A1 | 7/2010 | Nose et al. | |
| 2011/0202258 | A1 | 8/2011 | Fukushima et al. | |
| 2011/0297462 | A1 | 12/2011 | Grajkowski et al. | |
| 2012/0191275 | A1 | 7/2012 | Clever et al. | |
| 2013/0035009 | A1 | 2/2013 | Kuriyagawa et al. | |

OTHER PUBLICATIONS

U.S. Appl. No. 14/284,795, filed May 22, 2014, Unpublished.
U.S. Appl. No. 14/258,516, filed Apr. 22, 2014, Unpublished.
U.S. Appl. No. 13/787,108, filed Mar. 6, 2013, Unpublished.
Dengel et al., "Trim Control Systems and Methods for Marine Vessels," Unpublished U.S. Appl. No. 13/770,591, filed Feb. 19, 2013.
Arbuckle et al., "Systems and Methods for Setting Engine Speed Using a Feed Forward Signal," Unpublished U.S. Appl. No. 14/573,202, filed Dec. 17, 2014.

* cited by examiner

SYSTEMS AND METHODS FOR CONTROLLING A ROTATIONAL SPEED OF A MARINE INTERNAL COMBUSTION ENGINE

CROSS REFERENCE TO RELATED APPLICATION

This application claims the benefit of U.S. Provisional Application Ser. No. 61/994,221, filed May 16, 2014, which is hereby incorporated by reference herein.

FIELD

The present disclosure relates to systems and methods for controlling a rotational speed of an internal combustion engine of a marine propulsion device coupled to a marine vessel.

BACKGROUND

U.S. patent application Ser. No. 14/258,516, filed Apr. 22, 2014, which is hereby incorporated by reference herein, discloses a system that controls the speed of a marine vessel having first and second propulsion devices that produce first and second thrusts to propel the marine vessel. A control circuit controls orientation of the first and second propulsion devices about respective steering axis to control direction of the first and second thrusts. A first user input device is movable between a neutral position and a non-neutral detent position. When a second user input device is actuated while the first user input device is in the detent position, the control circuit does one or more of the following so as to control the speed of the marine vessel: varies a speed of a first engine of the first propulsion device and a speed of a second engine of the second propulsion device; and varies one or more alternative operating conditions of the first and second propulsion devices.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, a system controls a rotational speed of an internal combustion engine of a marine propulsion device coupled to a marine vessel. The system includes a first operator input device for controlling a speed of the engine in a trolling mode, in which the engine operates at a first operator-selected engine speed so as to propel the marine vessel at a first non-zero speed. A second operator input device controls the engine speed in a non-trolling mode, in which the engine operates at a second operator-selected engine speed so as to propel the marine vessel at a second non-zero speed. A controller is in signal communication with the first operator input device, the second operator input device, and the engine. In response to an operator request to transition from the trolling mode to the non-trolling mode, the controller determines whether to allow the transition based on a comparison of the second operator-selected engine speed with a current engine speed.

Another example of the present disclosure is of a method for controlling a rotational speed of an internal combustion engine of a marine propulsion device coupled to a marine vessel. The method includes receiving an operator request to transition from a trolling mode, in which the engine operates at a first operator-selected engine speed so as to propel the marine vessel at a first non-zero speed, to a non-trolling mode, in which the engine operates at a second operator-selected engine speed so as to propel the marine vessel at a second non-zero speed. The method also includes determining whether to allow the transition based on a comparison of the second operator-selected engine speed with a current speed of the engine.

BRIEF DESCRIPTION OF THE DRAWINGS

Examples of systems and methods for controlling a rotational speed of a marine internal combustion engine are described with reference to the following Figures. The same numbers are used throughout the Figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
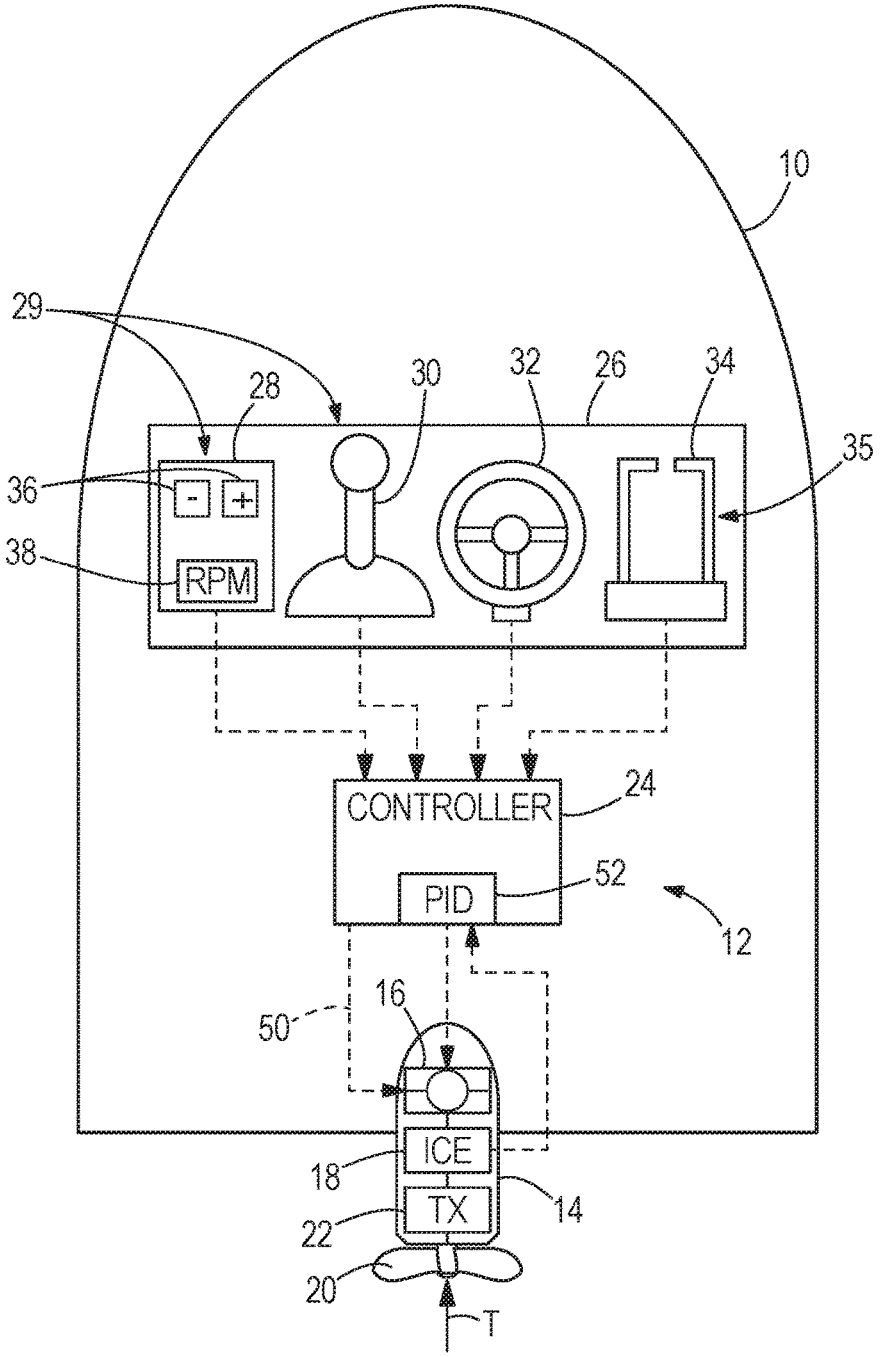
FIG. 1 illustrates a marine vessel having a marine propulsion system.

FIG. 1 illustrates one example of a marine vessel 10. The marine vessel 10 is capable of operating, for example, in a normal (non-trolling) mode or in a trolling mode, in which the marine vessel 10 operates at generally reduced speeds in comparison to operation of the marine vessel 10 in the non-trolling mode. Generally, trolling speeds are considered to be boat speeds under 10 mph, although this exact speed is not limiting on the scope of the present disclosure. In some instances, the operator of the marine vessel 10 may request an engine speed while in the trolling mode that ranges into a non-trolling-like engine speed. When the operator thereafter wishes to switch back to the non-trolling mode, he may experience a sharp decrease in vessel speed as the engine speed jumps from an engine speed at the high end of the trolling mode to an engine speed at the low end of the non-trolling mode. The present disclosure provides systems and methods for controlling a rotational speed of an internal combustion engine of the marine vessel 10 when transitioning from the trolling mode to the non-trolling mode, which systems and methods eliminate this sharp decrease in vessel speed, as well as realize other significant improvements over prior art systems and methods.

FIG. 1 illustrates a marine vessel 10 having a system 12 for controlling a rotational speed of an internal combustion engine 18 of a marine propulsion device 14 coupled to the marine vessel 10. The marine propulsion device 14 has a throttle valve 16 that controls an amount of air entering the internal combustion engine 18. The internal combustion engine 18 is operatively connected in a torque-transmitting relationship with a propeller 20 by way of a transmission 22. Rotation of the propeller 20 by the internal combustion engine 18 via the transmission 22 produces a thrust T, which depends on a direction of rotation of the propeller 20 as determined by the transmission 22.

The amount of air entering the intake manifold of the internal combustion engine 18 is controlled by the throttle valve 16, which in one example is an electronic throttle valve in signal communication with a controller 24. The controller 24 may also send signals to the transmission 22 (although such connection is not shown herein) in order to control whether the marine propulsion device 14 is in neutral, forward gear, or reverse gear.

The controller 24 may include a memory and a programmable processor. As is conventional, the processor can be communicatively connected to a computer readable medium that includes volatile or nonvolatile memory upon which computer readable code is stored. The processor can access the computer readable code, and the computer readable medium upon executing the code carries out functions as described herein below. In other examples of the system 12, more than one controller is provided, rather than the single controller 24 as shown herein. For example, a separate controller could be provided in order to interpret signals sent from a helm 26 of the marine vessel, and a separate controller could be provided for the marine propulsion device 14. It should be noted that the dashed lines shown in FIG. 1 are meant to show only that the various control elements shown therein are capable of communicating with one another, and do not represent actual wiring connecting the control elements, nor do they represent the only paths of communication between the elements. The connections shown herein could be wired (for example via a serially wired CAN bus) or wireless.

The helm 26 includes a number of user input devices, such as an interactive gauge 28, a joystick 30, a steering wheel 32, and a throttle lever 34. An operator of the marine vessel 10 can use each of these devices to input commands to the controller 24. The controller 24 interprets these commands and in turn communicates with the propulsion device 14, such as for example to provide commands regarding the magnitude and direction of thrust T produced by the propulsion device 14.

In one example, the gauge 28 comprises a first operator input device 29 for controlling a speed of the engine 18 in a trolling mode, in which the engine 18 operates at first operator-selected engine speed so as to propel the marine vessel 10 at a first non-zero speed. Also, according to the present example, the throttle lever 34 comprises a second operator input device 35 for controlling the engine speed in a non-trolling mode, in which the engine 18 operates at a second operator-selected engine speed so as to propel the marine vessel 10 at a second non-zero speed. As mentioned above, the controller 24 is in signal communication with the first operator input device 29, the second operator input device 35, and the engine, 18. As described herein below, in response to an operator request to transition from the trolling mode to the non-trolling mode, the controller 24 determines whether to allow the transition based on the second operator-selected engine speed and a current engine speed. In order to describe the system and method of the present disclosure, which control the rotational speed of the internal combustion engine 18 when an operator request to transition from the trolling mode to the non-trolling mode is made, operation of the system 12 in the trolling mode and the non-trolling mode will now be described.

Figure 2:
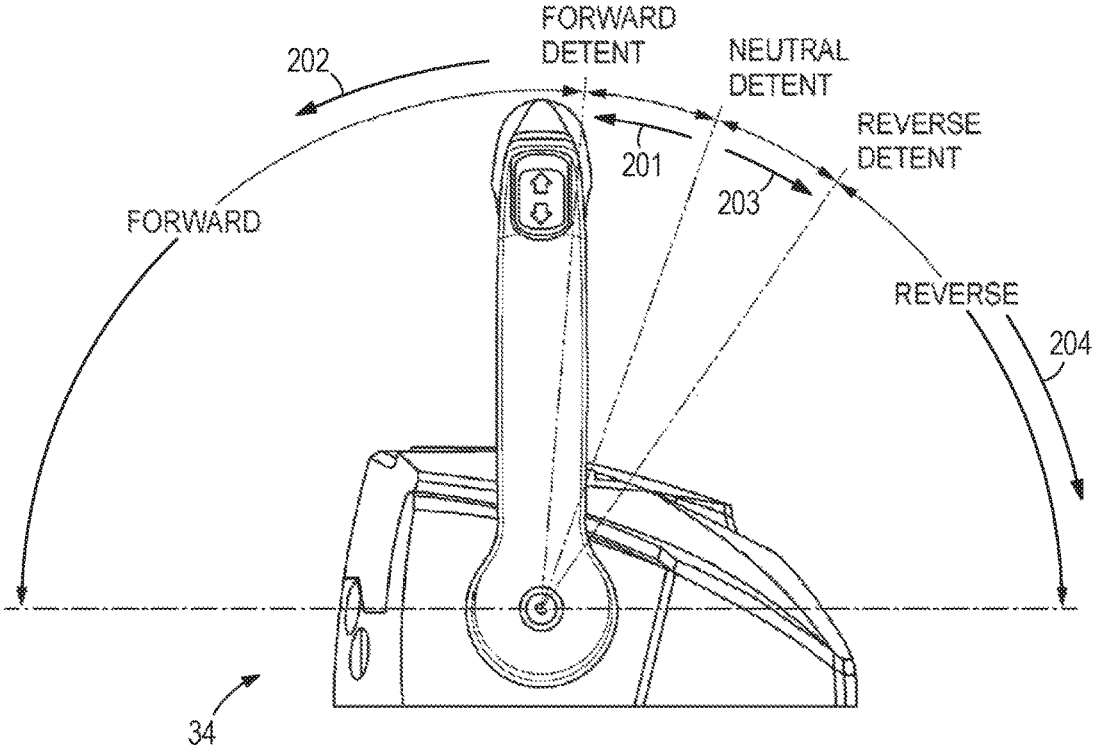
FIG. 2 illustrates one example of a throttle lever.

FIG. 2 shows one example of a throttle lever 34, as well as a number of positions to which the throttle lever 34 can be actuated. As shown in FIG. 2, the throttle lever 34 can be moved from a neutral detent position to a forward detent position (see arrow 201), in which the engine 18 of the marine propulsion device 14 is in gear, but idling. Thereafter, the throttle lever 34 can be actuated further in the forward direction (in the direction of arrow 202) to cause the transmission 22 to connect the engine 18 and the propeller 20 in forward gear and thereby provide forward thrust to the marine vessel 10. As the operator continues to move the throttle lever 34 in the forward direction along arrow 202, the controller 24 will increasingly open the throttle valve 16 of the marine propulsion device 14, thereby increasing the speed of the engine 18 and propeller 20, and thus the speed of the marine vessel 10. If the throttle lever 34 is moved in the opposite direction, i.e. from neutral detent to reverse detent (see arrow 203), the marine propulsion device 14 is put in reverse gear, but idling. As the throttle lever 34 is moved even more in the reverse direction (see arrow 204), the throttle valve 16 is increasingly opened and the marine propulsion device 14 provides reverse thrust to the marine vessel 10.

In one example, in order to place the system 12 in the trolling mode, the user may place the throttle lever 34 in one of the forward detent and reverse detent positions. For exemplary purposes, entry into the trolling mode will be described with respect to the throttle lever 34 being placed in the forward detent position. After the throttle lever 34 has been placed in the forward detent position, the operator may manipulate the gauge 28 in order to increase or decrease the speed of the engine 18. The operator may do so by interacting with the gauge 28 via buttons 36 that allow adjustment of the engine speed. For example, the plus button may be used to increase the rotational speed of the engine 18 and the minus button may be used to decrease the speed of the engine 18. The gauge 28 may comprise a device having actuatable buttons, or the gauge 28 may comprise an interactive display, in which the buttons 36 are selectable via a touch screen. The gauge 28 may also include a display 38 that shows the current rotational speed of the engine 18 in RPM. The display 38 may also show the setpoint engine speed that the operator has entered, which setpoint engine speed corresponds to the first operator-selected engine speed.

When the operator places the throttle lever 34 in forward detent, the controller 24 sends a signal to the transmission 22 to couple the engine 18 to the propeller 20 in forward gear, while the engine 18 remains at an idle speed. In one example, the idle speed is 600 RPM. The operator may use the buttons 36 on the gauge 28 to increase or decrease the operator-selected engine speed to as low as, for example 500 RPM, and as high as, for example 1200 RPM. (These RPM values are merely exemplary, and are not limiting on the scope of the present disclosure.) After the operator inputs the operator-selected engine speed, the controller 24 sets this engine speed as an engine speed setpoint, and sends a signal to the throttle valve 16 to open or close to achieve the engine speed setpoint.

Figure 3B:
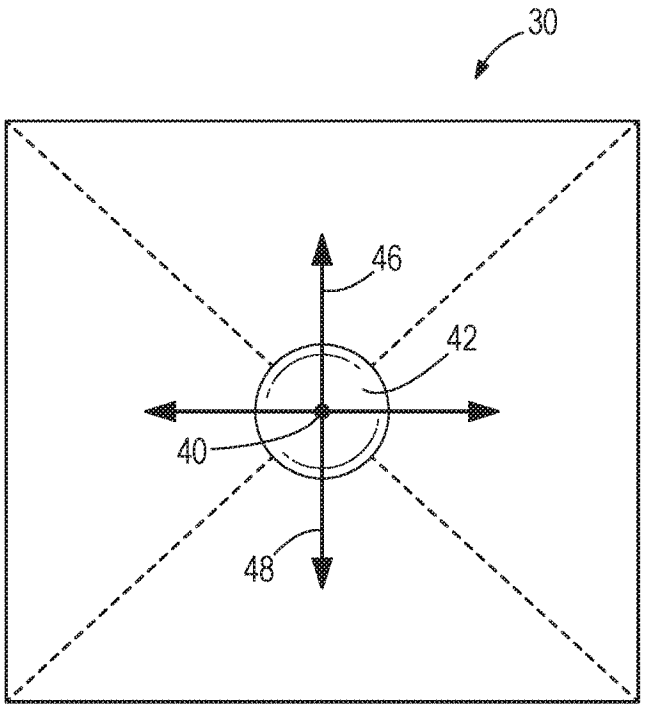
FIGS. 3A and 3B illustrate one example of a joystick.
Figure 3A:
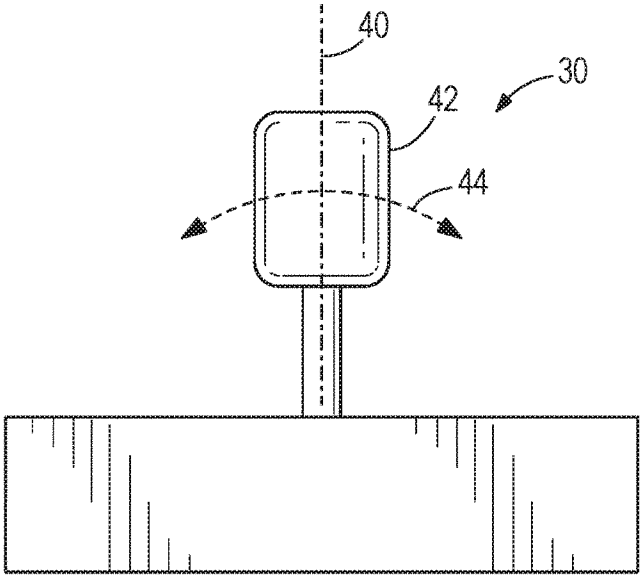

In another example, referring to FIGS. 3A and 3B, the joystick 30 may be used to increase or decrease the first operator-selected engine speed. The joystick 30 is therefore another example of a first operator input device 29 for controlling a speed of the engine 18 in the trolling mode. FIG. 3A shows a side view of the joystick 30, and indicates how the joystick 30 has an upright detent position, as indicated by axis 40. The joystick 30 can be engaged via a knob 42 such that it can be moved along arrow 44 in one of two directions so as to increase or decrease the first operator-selected engine speed. FIG. 3B shows how the joystick 30 can in fact be moved in four directions, although only a first and second direction will be described herein. Joystick 30 can be moved away from the upright detent position (aligned with axis 40) in a first (forward) direction as shown by the arrow 46 or in a second (backward) direction as shown by the arrow 48. If the operator taps the joystick 30 forward (arrow 46) or backward (arrow 48) and then allows the joystick to return to its upright detent position (along axis 40) this sends a signal to controller 24 to effect a small increase or decrease in the rotational speed of the engine 18. If the operator instead moves the joystick 30 forward or backward with constant pressure, this sends a signal to the controller 24 to effect a continuously increasing or decreasing engine speed.

Now returning to FIG. 2, operation of the system 12 in the non-trolling mode will be described. According to the present disclosure, the throttle lever 34 is one example of a second operator input device 35 for controlling the engine speed in a non-trolling mode, in which the engine 18 operates at a second operator-selected engine speed so as to propel the marine vessel 10 at a second non-zero speed. Other examples of the second operator input device 35 include push buttons, an interactive video display, or the joystick 30. For exemplary purposes, the throttle lever 34 will be used to describe the present system. As described herein above, the throttle lever 34 has several different positions. When in the neutral detent position, the throttle lever 34 sends a signal to the controller 24 to operate the marine propulsion device 14 in a neutral mode, in which the engine 18 is running, but the propeller 20 and engine 18 are not connected via the transmission 22. In one example, when the throttle lever 34 is in neutral, the throttle valve 16 is closed and the engine 18 is provided with air from an idle air control valve. In another example, the throttle valve 16 is open, but just enough to effect an idling speed. When the throttle lever 34 is placed in the forward detent position, the transmission 22 connects the engine 18 and propeller 20 in forward gear. However, the throttle valve 16 remains in a position at which not enough air is provided to the engine 18 to provide the torque required to turn the propeller 20, and therefore the propeller 20 does not provide thrust to propel the marine vessel 10. This same description applies to actuation of the throttle lever 34 into the reverse detent position, only the transmission 22 is placed in reverse gear.

When the throttle lever 34 is actuated out of the forward detent position and further in the direction of arrow 202, the throttle valve 16 is thereafter opened to provide air to the engine 18 in an amount that causes the engine 18 to create enough torque to cause the propeller 20 to turn against the force of the water tending to hold it in place, and to produce a thrust to propel the marine vessel 10. In prior art systems, the signal sent from the throttle lever 34 to the controller 24 was interpreted as a request for the throttle valve 16 to open to a specified percentage of its wide-open position. The rotational speed of the engine 18 would thereafter respond according to a load on the system (e.g. weight of the marine vessel 10) and according to available airflow from the throttle valve 16. In contrast, the present system 12 operates such that a user input at the throttle lever 34 is mapped directly to an operator-requested engine speed (RPM setpoint) that the controller 24 commands to the engine 18 to achieve. An example of such a system is provided in U.S. Pat. No. 8,762,022, which is hereby incorporated by reference.

For example, referring to FIG. 1, in response to the operator changing the operator-selected engine speed at the throttle lever 34 from a current operator-selected engine speed to a new operator-selected engine speed, the controller 24 first looks up the new engine speed setpoint corresponding to the new position of the throttle lever 34. The controller 24 then makes a prediction as to the position of the throttle valve 16 needed to provide the new operator-selected engine speed. The controller 24 provides a feed forward signal along line 50 to move the throttle valve 16, which feed forward signal bypasses a feedback control section 52 (such as a PID control loop) of the controller 24. The throttle valve 16 is then moved to the predicted throttle position in response to the feed forward signal. The feedback control section 52 thereafter uses a difference between a measured current engine speed (for example, measured by a tachometer) and the second operator-selected engine speed (input via throttle lever 34) to adjust the position of the throttle valve 16 to obtain the second operator-selected engine speed. In other examples, a feed forward signal is not used, and the feedback controller 52 is alone used to achieve and maintain the second operator-selected engine speed.

The present system and method are directed towards controlling the rotational speed of the engine 18 when the operator requests a transition from the trolling mode to the non-trolling mode. In one example, the controller 24 receives the operator request to transition from the trolling mode to the non-trolling mode in response to movement of the throttle lever 34 beyond a non-neutral detent position. For example, referring to FIG. 2, the controller 24 may receive the operator request in response to the operator moving the throttle lever 34 further in the forward direction from the forward detent position (see arrow 202), or further in the reverse direction from the reverse detent position (see arrow 204). Such operator requests indicate that the operator wishes the marine vessel 10 to "drive off" of the trolling mode into the non-trolling mode, wherein engine speed is controlled by movement of the throttle lever 34 rather than by input to the gauge 28.

In one example, the controller 24 allows the transition from the trolling mode to the non-trolling mode only if the second operator-selected engine speed (as input by the second operator input device 35, e.g. throttle lever 34) is greater than the current engine speed. Additionally, the controller 24 may allow the transition from the trolling mode to the non-trolling mode only if the controller 24 receives an input from the second operator input device 35 that exceeds a predetermined threshold. In one example, this threshold is an idle threshold and the operator must actuate the exemplary throttle lever 34 beyond the forward detent position or beyond the reverse detent position in order to exceed the idle threshold.

Figure 4:
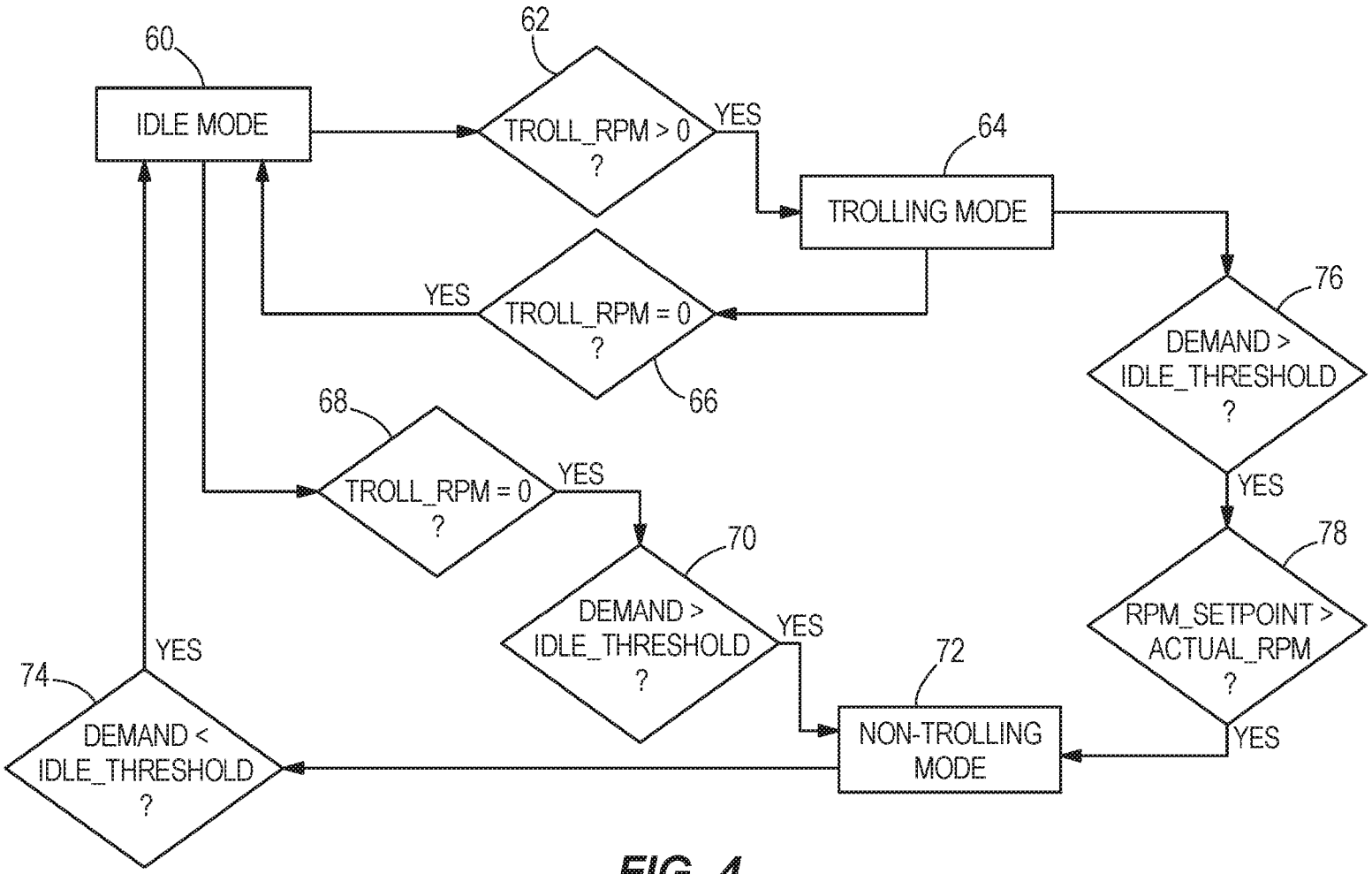
FIG. 4 illustrates one example of a logic diagram for carrying out a method according to the present disclosure.

FIG. 4 illustrates a logic diagram of one example of how the controller 24 determines in which mode the system 12 is to be operated. In one example, the system 12 starts in an idle mode as shown at box 60. In idle mode, as described above, the engine 18 is idling using air provided from an idle air control valve and the throttle valve 16 is closed (or the throttle valve 16 is opened only enough to effect idling speeds) and the throttle lever 34 is in either the neutral, forward detent, or reverse detent position. According to the present example, if the throttle lever 34 is in the forward detent or reverse detent position, the system 12 is capable of being operated in the trolling mode. At decision point 62, the controller 24 determines whether the first operator-selected engine speed (Troll_RPM), input by the operator via gauge 28 or joystick 30, is greater than zero. If the Troll_RPM is greater than zero, the system 12 is thereafter operated in the trolling mode as shown at box 64, wherein the speed of the engine 18 is set to the first-operator-selected engine speed. The system 12 may exit the trolling mode and return to idle mode if the controller 24 determines at decision point 66 that the Troll_RPM input by the operator is equal to zero.

Returning to box 60, while the system 12 is in the idle mode, the controller 24 also determines as shown at decision point 68 whether the Troll_RPM equals zero, i.e. the operator is not requesting the trolling mode. If the answer at point 68 is yes, the controller 24 determines whether the operator's demand input is greater than an idle threshold, as shown at decision point 70. In one example, the operator's demand input is based on a position of the throttle lever 34, and is considered to be greater than the idle threshold if the throttle lever 34 is moved further forward than the forward detent position (FIG. 2, arrow 202), or is moved further backward than the reverse detent position (FIG. 2, arrow 204). If the answer at point 70 at yes, the system 12 is operated in the non-trolling mode as shown at box 72, wherein the speed of the engine 18 is set to the second operator-selected engine speed based on the position of the throttle lever 34 according to the above-described method. The system 12 will remain in the non-trolling mode until a determination is made at decision point 74 that the operator's demand input is less than the idle threshold. This would be true if, for example, the throttle lever 34 is placed back into forward detent, reverse detent, or the neutral. The system would then return to idle mode at box 60.

Returning to box 64, while the system 12 is operating in the trolling mode, the controller 24 determines at decision point 76 whether the operator's input demand is greater than the idle threshold. As described herein above, this is true if the throttle lever 34 is moved out of the forward detent or reverse detent positions further into the forward or reverse positions, respectively. If the answer at 76 is yes, the controller 24 determines at decision point 78 whether the second operator-requested engine speed (RPM_Setpoint) is greater than the current engine speed (Actual_RPM). Effectively, the controller 24 determines whether the second operator-requested engine speed mapped from the position of the throttle lever 34 is greater than the current speed of the engine 18. If yes, the system 12 transitions to the non-trolling mode shown at box 72. If no at point 78, the system remains in the trolling mode.

The present system and method therefore solve a particular problem when the system 12 is transitioning from the trolling mode to the non-trolling mode, which problem is encountered when the speed of the engine 18 in the trolling mode is greater than the engine speed that is requested via the throttle lever 34 when a drive off request is made. For example, the operator may currently be trolling at a first operator-selected engine speed of 1200 RPM using the gauge 28 or joystick 30, and may subsequently move the throttle lever 34 to a position that is just above the idle threshold, knowing that doing so will drive the marine vessel off of trolling mode. The position of the throttle lever 34 just above the idle threshold, however, may map or correspond to a second operator-selected engine speed of only, for example, 700 RPM. The controller 24 would then command the engine 18 to decelerate quickly from 1200 RPM to 700 RPM. This drop in engine speed is undesirable, as it causes the operator to lurch forward as the marine vessel 10 quickly decelerates, even though deceleration was likely not the operator's intent when he made the drive off maneuver.

To remedy this situation, the present system and method do not allow a transition from the trolling mode to the non-trolling mode until the engine speed setpoint as requested via the throttle lever 34 is greater than the actual speed of the engine 18, thereby preventing the above-described sudden drop in engine speed. Effectively, the system 12 does not transition out of the trolling mode and into the non-trolling mode until the operator has moved the throttle lever 34 beyond a position that maps to the current engine speed. Additionally, the system 12 does not transition from the trolling mode to the non-trolling mode until the operator's input demand at throttle lever 34 is greater than the idle threshold (i.e., until the throttle lever 34 is moved out of the forward or reverse detent position). Requiring this second condition in addition to the first allows the operator to troll at an engine speed that is less than the idle speed threshold. For example, if the idle speed threshold of the engine is 600 RPM, the operator can troll at 500 RPM without the controller 24 kicking the system 12 out of the trolling mode, even though the engine speed corresponding to the position of the throttle lever 34 (which, recall, is at the idle threshold, in order to activate the trolling mode) is greater than the actual engine speed. By using both the throttle lever position vis a vis the idle threshold and the operator-selected engine speed corresponding to the position of the throttle lever to dynamically move the trolling mode on/off threshold, a smooth, seamless transition between the trolling mode and the non-trolling mode can be achieved.

Other methods of exiting the trolling mode are not affected by the system and method of the present disclosure, and include: (1) exiting trolling mode upon detection of the idle threshold if the requested engine speed in the trolling mode is below the engine speed as requested by the throttle lever 34, or (2) exiting or disabling trolling mode in response to operator input via the gauge 28, joystick 30, or other input device, such as an interactive video display.

Figure 5:
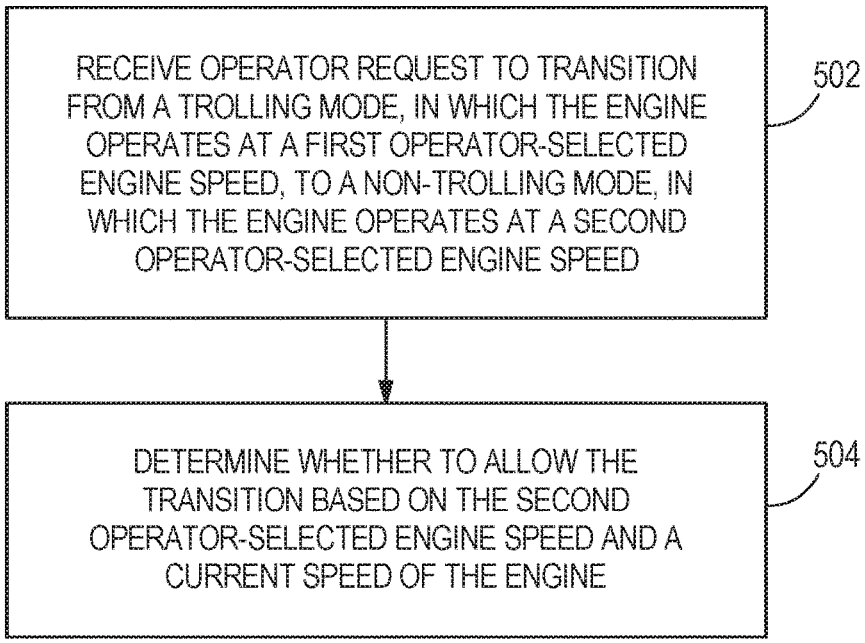
FIG. 5 is illustrates another example of a method according to the present disclosure.

Turning to FIG. 5, a method for controlling a rotational speed of an internal combustion engine 18 of a marine propulsion device 14 coupled to a marine vessel 10 will be described. As shown at 502, the method comprises, receiving an operator request to transition from a trolling mode, in which the engine 18 operates at a first operator-selected engine speed so as to propel the marine vessel 10 at a first non-zero speed, to a non-trolling mode, in which the engine 18 operates at a second operator-selected engine speed so as to propel the marine vessel 10 at a second non-zero speed. The method further comprises, as shown at 504, determining whether to allow the transition based on the second operator-selected engine speed and a current speed of the engine 18.

The method may further comprise determining if the second operator-selected engine speed is greater than the current engine speed, and if so, transitioning from the trolling mode to the non-trolling mode in response to the operator request. The method may further comprise one of controlling a speed of the engine 18 in the trolling mode according to inputs from a first operator input device 29, and controlling the engine speed in the non-trolling mode according to inputs from a second operator input device 35.

In one example, the second operator input device 35 is a throttle lever 34 having a non-neutral (i.e. forward or reverse) detent position. The method may further comprise controlling the engine 18 in the trolling mode when the throttle lever 34 is in the non-neutral detent position and the first operator input device 29 is thereafter actuated. In one example, the first operator input device 29 is a gauge 28 with buttons 36 that allow adjustment of the first operator-selected engine speed.

The method may further comprise receiving the operator request to transition from the trolling mode to the non-trolling mode in response to movement of the throttle lever 34 beyond the non-neutral detent position. The method may further comprise transitioning from the trolling mode to the non-trolling mode in response to the operator request only if an input from the throttle lever 34 exceeds a predetermined threshold. In one example, this predetermined threshold is an idle threshold, as indicated by position of the throttle lever 34 in a forward detent or reverse detent position.

The method may further comprise predicting a position of a throttle valve 16 of the engine 18 that will provide the second operator-selected engine speed, and sending a feed forward signal to the throttle valve 16 to move the throttle valve 16 to the predicted position. The method may further comprise using a difference between the current engine speed and the second operator-selected engine speed to adjust the position of the throttle valve 16 to obtain the second operator-selected engine speed.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A system for controlling a rotational speed of an internal combustion engine of a marine propulsion device coupled to a marine vessel, the system comprising:

a first operator input device for controlling the engine speed in a trolling mode, such that the engine operates at a first operator-selected engine speed and propels the marine vessel at a first non-zero speed;

a second operator input device for controlling the engine speed in a non-trolling mode, such that the engine operates at a second operator-selected engine speed and propels the marine vessel at a second non-zero speed; and a controller in signal communication with the first operator input device, the second operator input device, and the engine;

wherein, in response to an operator request to transition from the trolling mode to the non-trolling mode, the controller determines whether to allow the transition based on a comparison of the second operator-selected engine speed with a current, measured engine speed and thereafter operates the marine propulsion device in the trolling mode or the non-trolling mode, as appropriate, based on the determination;

wherein the controller allows the transition from the trolling mode to the non-trolling mode if the second operator-selected engine speed is greater than the current engine speed and if the controller receives an input from the second operator input device that exceeds a predetermined threshold.

2. The system of claim 1, wherein the second operator input device is a throttle lever having a non-neutral detent position.

3. The system of claim 2, wherein the controller operates the marine propulsion device in the trolling mode when the throttle lever is in the non-neutral detent position and the first operator input device is thereafter actuated.

4. The system of claim 3, wherein the controller receives the operator request to transition from the trolling mode to the non-trolling mode in response to movement of the throttle lever beyond the non-neutral detent position.

5. The system of claim 1, further comprising a throttle valve of the engine in signal communication with the controller, wherein the controller predicts a position of the throttle valve that will provide the second operator-selected engine speed, and sends a feed forward signal to the throttle valve to move the throttle valve to the predicted position.

6. The system of claim 5, further comprising a feedback control section of the controller that uses a difference between the current engine speed and the second operator-selected engine speed to adjust the position of the throttle valve to obtain the second operator-selected engine speed.

7. The system of claim 1, wherein the first operator input device is a gauge with buttons that allow adjustment of the first operator-selected engine speed.

8. The system of claim 1, wherein the first operator input device is a joystick, and wherein movement of the joystick in a first direction increases the first operator-selected engine speed and movement of the joystick in a second, opposite direction decreases the first-operator-selected engine speed.

9. A method for controlling a rotational speed of an internal combustion engine of a marine propulsion device coupled to a marine vessel, the method being carried out by a controller and comprising:

receiving an operator request to transition from a trolling mode, in which the engine operates at a first operator-selected engine speed in response to inputs from a first operator input device and propels the marine vessel at a first non-zero speed, to a non-trolling mode, in which the engine operates at a second operator-selected engine speed in response to inputs from a second operator input device and propels the marine vessel at a second non-zero speed; and determining whether to allow the transition based on a comparison of the second operator-selected engine speed with a current, measured speed of the engine, wherein the controller allows the transition from the trolling mode to the non-trolling mode in response to the operator request if the second operator-selected engine speed is greater than the current engine speed and if an input from the second operator input device exceeds a predetermined threshold; and operating the marine propulsion device in the trolling mode or the non-trolling mode, as appropriate, based on the determination.

10. The method of claim 9, wherein the second operator input device is a throttle lever having a non-neutral detent position.

11. The method of claim 10, further comprising operating the marine propulsion device in the trolling mode when the throttle lever is in the non-neutral detent position and the first operator input device is thereafter actuated.

12. The method of claim 11, further comprising receiving the operator request to transition from the trolling mode to the non-trolling mode in response to movement of the throttle lever beyond the non-neutral detent position.

13. The method of claim 9, wherein the first operator input device is a gauge with buttons that allow adjustment of the first operator-selected engine speed.

14. The method of claim 9, further comprising predicting a position of a throttle valve of the engine that will provide the second operator-selected engine speed, and sending a feed forward signal to the throttle valve to move the throttle valve to the predicted position.

15. The method of claim 14, further comprising using a difference between the current engine speed and the second operator-selected engine speed to adjust the position of the throttle valve to obtain the second operator-selected engine speed.

* * * * *